US005114080A

United States Patent [19]

Pujol

[11] Patent Number: 5,114,080

[45] Date of Patent: May 19, 1992

[54] GRINDING BODY SEPARATOR IN MILLS FOR TRITURATING AND BREAKING UP SOLIDS PREDISPERSED IN LIQUIDS

[75] Inventor: Carlos O. Pujol, Badalona, Spain

[73] Assignee: Oliver Y Batlle, S.A., Badalona, Spain

[21] Appl. No.: 718,350

[22] Filed: Jun. 19, 1991

[51] Int. Cl.[5] ..... B02C 17/16

[52] U.S. Cl. ..... 241/69; 241/171; 209/285

[58] Field of Search ..... 241/171, 69; 209/285, 209/300, 675

[56] References Cited

U.S. PATENT DOCUMENTS

| | | | |
|---|---|---|---|
| 1,185,794 | 6/1916 | Haug | 209/270 |
| 4,620,673 | 11/1986 | Canepa et al. | 241/69 |
| 4,651,935 | 3/1987 | Samosky et al. | 241/65 |
| 4,709,863 | 12/1987 | Szkaradek et al. | 241/69 |
| 4,824,033 | 4/1989 | Buehler | 241/66 |
| 5,051,167 | 9/1991 | Höglund | 209/270 |

*Primary Examiner*—Mark Rosenbaum
*Assistant Examiner*—John M. Husar

[57] ABSTRACT

Grinding body separator in mills for triturating and breaking up solids predispersed in liquids, which has a truncated cone-shaped stepped support, the major base of which has a flange for mounting in the mill and on the steps of which are fitted respective circular rings, provided with transverse orifices and which are superposed on one another leaving an outer separation smaller than the smallest thickness of the grinding bodies and an inner separation greater than the former, the assembly of rings being secured by a disk, which itself is secured to the minor base of the support and which delimits an outer separation, relative to the smallest ring, equal to that between the superposed rings.

1 Claim, 6 Drawing Sheets

GRINDING BODY SEPARATOR IN MILLS FOR TRITURATING AND BREAKING UP SOLIDS PREDISPERSED IN LIQUIDS

The present Patent of Invention relates to a grinding body separator in mills for triturating and breaking up solids predispersed in liquids, which contributes, to the function for which it is intended, several advantages to be indicated below, apart from others inherent in its organization and constitution.

Known are mills, normally with horizontal shaft and cooled, for products consisting of solids predispersed in liquids, of different viscosity, which mills comprise grinding bodies, for example balls, which enter the grinding chamber through the inlet mouth for the product to be treated or through a mouth provided for that purpose; normally they are extracted through an outlet in the bottom of said chamber, which is provided with a double wall for cooling or heating. Said known mills may include a circulating pump for the cooling or heating liquid, said mills having a shaft on which are mounted interchangeable agitation disks disposed at predetermined distances from each other by means of spacers between them, said shaft being driven by a motor via the proper transmission and optionally speed control, and having also a pump, with flow regulator, which impels the product to be treated for its forced and continuous passage through the grinding chamber.

Known also are mills, both with horizontal or vertical shaft, with a cylindrical fixed element or stator and a cylindrical rotating element or rotor disposed in their interior, the grinding chamber being formed between the latter and the cylindrical inner wall of said stator; and the grinding bodies return to the grinding chamber through passages, having also at least a cooling chamber in the stator and sometimes in the rotor.

Also, mills are known like those described before, but in which the grinding chamber is defined by two coaxial cylindrical walls provided with radial lugs, between which the cylindrical jar-shaped rotor is disposed, also provided with lugs on its two parallel surfaces opposite said two walls.

In addition, there are known mills with horizontal or vertical shaft, provided with at least one fixed element or stator along an annular double cone and with at least one rotor also along an annular double cone and introduced in said stator, that is, the rotor has the form of a circular ring of triangular cross section and is introduced into a circular canal of the stator, which is of the same cross section but somewhat larger; in fact, the configuration of said stators and rotors is that of a torus of substantially triangular cross section, possibly of a double triangle or other similar form, both for the stator and for the rotor, the transverse section of the latter being inscribed in the interior of that of the stator and leaving between the two a perimetric space which constitutes the grinding chamber in which the product circulates and in which the balls are enclosed which circulate along a closed path, by means of a return passage of said balls to the beginning of their path. Also the configuration of the rotors in these mills is, sometimes, that of a "disk" of triangular section of revolution with a vertex, normally the most acute, in its peripheral part and, in this case, more than one of such disks can be disposed parallel to each other and transversely to the shaft of the mill, which grinding chambers are connected in series or in parallel, with respect to the circuit to be followed by the product in treatment.

Lastly there are known mills of the type described, formed by one or more plates, which have passages for the recirculation in closed circuit of the balls or grinding bodies and each of said plates being disposed inside a hollow body of corresponding configuration and so that between each plate or rotor and its body or stator a grinding chamber is defined more or less in labyrinth form and each chamber communicating with the next one to cause a circulation of the product in treatment, all plates being actuated by a single shaft.

In these known mills there is always a strainer or separator for retaining the grinding bodies inside the grinding chamber, but permitting the passage of the ground product only; such strainers consist of a sieve, possibly rotating with the shaft or being static and fastened to the grinding chamber in the outlet zone of the treated product. There are also mills in which the strainer or separator of the grinding bodies consists of the so-called "gap", defined by a kind of washer of special material fastened transversely on the mill shaft, said washer being disposed at a certain adjustable distance from another washer fastened to the corresponding wall of the grinding chamber and opposite to it, leaving between the two a peripheral clearance smaller than the smallest diameter of the grinding bodies, to retain them inside said grinding chamber, but letting the ground product pass as it is being treated in the mill.

The grinding bodies may consist of small balls or of other suitable geometric forms and be of metal, including various alloys, ceramics, glass, etc., but they must always be resistant to wear and to the stresses deriving from the grinding treatment of the respective products to be ground. As has been stated, the grinding bodies may be balls, but no limitation to spherical bodies is intended, but rather bodies of various configurations are included, able to triturate the solid particles of the products to be ground, by impacts and frictions between themselves and with the limiting surfaces of the grinding chamber, and said grinding bodies are to have dimensions which are a function of the final fineness desired for the solid components of the product to be ground.

In general, these mills are used for the treatment of dyes, paints, pesticides or other chemical products, pharmaceutics, foods, cosmetics, electronic products, etc.; having application in the chemical industry in general and, in particular, in the industry of dyes and paints, printing inks, pigments and coatings, paper industry, for grinding the charges to be used in pulps for making paper and other products such as copy paper, in biochemical industries, in the food industry for innumerable products, such as chocolate products, in the electronic industry for coatings of magnetic tapes and of semiconductor products, and in the pharmaceutical and cosmetic industry.

In some of the known types of mills described before, the product to be treated circulates through the grinding chamber in a forced and continuous manner, normally impelled by a pump of variable and adjustable flow, at or near the entrance of the mill.

Lastly it is known also that the grinding bodies exert, in these mills, impact and friction streses on the solid particles of the product in treatment, in that very many contacts occur between said grinding bodies and the solid particles of the product in treatment. And the grinding bodies occupy a part of the volume of the grinding chamber which is variable and depends on the characteristics of the product to be treated, but normally the occupied volume of the total volume of said chamber ranges between 50% and 80%. The materials of which the separators are made must be wear resistant, and often their working surfaces are given hardening treatments.

The sieve type separators generally do not allow a very fine adjustment for microballs and produce clogging, being also relatively difficult to clean, hence requiring relatively much labor, and in case of wear they must be replaced, as repairing them is not economical.

Gap type separators involve a certain amount of wear as they have one part movable relative to the other, with relatively complicated disassembly and reassembly as the shaft and other parts of the mill must be disassembled for cleaning, overhaul or replacement.

The grinding body separator in mills for triturating and breaking up solids predispersed in liquids, which is the subject of the present invention, corresponds to the type which comprises a frame on which is mounted a fixed element or stator, with a jacket for the cooling and, if and when applicable, for the heating of the product in treatment, in the interior of which a rotating element or rotor is disposed fastened to a shaft disposed along the longitudinal axis of the mill and mounted overhung on respective supporting and bearing means, attached to the frame of the mill, which shaft has internal lines for rotor cooling and, if and when applicable, heating media, and is made to rotate by drive means through respective transmission and speed variation means attached to the frame, there being defined between said stator and rotor the grinding chamber, in which grinding bodies are enclosed which are initially introduced into said chamber through a closable entrance of the stator, in whose lower part is located a likewise closable outlet for their evacuation, the grinding chamber being traversed by the product in treatment—while the rotor rotates—owing to means of impulsion of said product, which are moved by drive means and through transmission and speed variation means, the stator having an entrance of the product to be treated, communicating with the exit of the impulsion means and an exit of the ground product, in the exit zone of which are disposed separator means which prevent the grinding bodies from coming out but let the ground product pass, seal means being disposed between the stator and the shaft to prevent leakage of product which circulates in a continuous and forced manner through the grinding chamber.

And this separator is characterized in that it presents a preferably hollow stepped support, whose ideal geometric envelope is a truncated cone, whose steps are formed by a series of circular rims superposed along parallel planes, perpendicular to the longitudinal axis of the separator and of decreasing diameter from the major base of the support to its free end, which series alternates with another series of short circular superposed cylinders, whose centers are disposed in said longitudinal axis of the separator and whose diameters are also decreasing in coordination with the respective diameters of said rims, the major base of the support comprising a flange and seal means for its installation in the respective mill, in the exit zone of the ground product; in that it presents a series of circular rings of diameters decreasing from the major base of the support to its free end, each of them made up of an inner collar and an outer collar, both of square cross section and interconnected by bridges which delimit respective transverse orifices or passages, each ring fitting on a respective step, for which purpose the inside diameter of its inner collar matches the outside diameter of the circular cylinder of the step on which it is mounted; in that the outside diameter of the outer collar of each of the rings that follow the largest of them coincides with the inside diameter of the outer collar of the ring on which it is juxtaposed, and the thickness—measured in the direction of the longitudinal axis of the separator—of the inner collar of a ring is somewhat greater than that of its outer collar, causing a separation between each pair of juxtaposed rings—in axial direction—which is smaller than the smallest thickness or diameter of the grinding bodies to be retained in the grinding chamber; in that the outer collar of each of the rings that follow the largest of them delimits a space, relative to the inner collar of the rings on which it is juxtaposed, which is greater than said separation between each pair of rings; in that, preferably, there is removably fastened on the major base of the support a first circular collar of square cross section and of an outside diameter greater than that of the largest of the series of rings, whose inside diameter coincides with the outside diameter of the outer collar of the largest ring, and also there is provided, in coplanar and coaxial arrangement, a second circular collar similar to the first but smaller and practically equal to the inner collar of the largest ring to which it is juxtaposed, the thickness of said second collar—in axial direction—being somewhat greater than that of the outer collar of said largest ring, causing a separation—in axial direction—between the two smaller than the smallest thickness or diameter of the grinding bodies, defining between the first and second circular collars a kind of channel for the passage of the ground product toward the exit of the mill, through at least one longitudinal orifice in the flange of the support; and in that the assembly composed of the series of rings and the second collar is retained and immobilized by means of a disk applied against the smallest ring and removably fastened on the minor base of the stepped support of the separator, the outside diameter of said disk being equal to the inside diameter of the outer collar of the smallest ring, and between the peripheral edge of this disk and the opposite edge of said outer collar of the smallest ring a separation is defined equal to that between each pair of juxtaposed rings.

The grinding body separator in mills for triturating and breaking up solids predispersed in liquids which is the subject of this Patent of Invention eliminates the mentioned disadvantages of the separators of the known mills and contributes, among others, the advantages of permitting a fine adjustment for microballs or the like, being easy to clean, simple to install and to disassemble, allowing them to be reused as they can be corrected mechanically, requiring less treatment time of the products to be ground, of greater efficiency and taking up less space, as well as providing a finer and more uniform finished product more homogeneous in the distribution and size of the solids dispersed in respective liquids, after they have been treated and have passed through the separator in question, and reducing the probability of any clogging or stopping up of the ground product in its passage through the separator.

The separator according to the present Patent of Invention offers the advantages that have been described above, in addition to others which will be readily seen from the example of realization of said separator, which are described in greater detail below to facilitate the comprehension of the characteristics set forth before, at the same time giving various details and attaching hereto, for that purpose, drawings in which, only by way of example and not limiting the scope of the present invention, a practical case is represented of the grinding body separator in mills for triturating and breaking up solids predispersed in liquids that is the subject of the invention.

Figure 2:
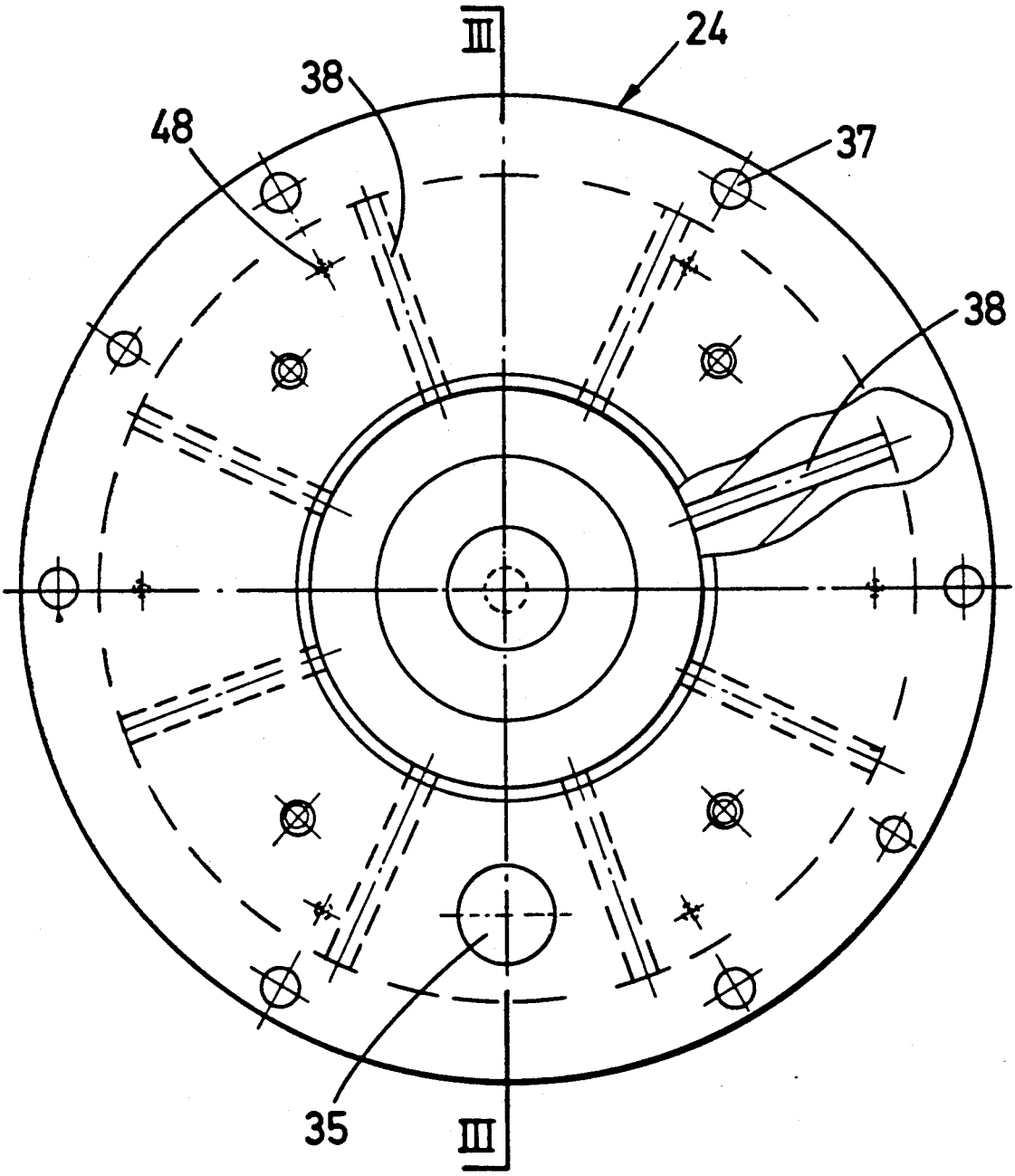
FIG. 2 is a front end view of the support of the separator.
Figure 3:
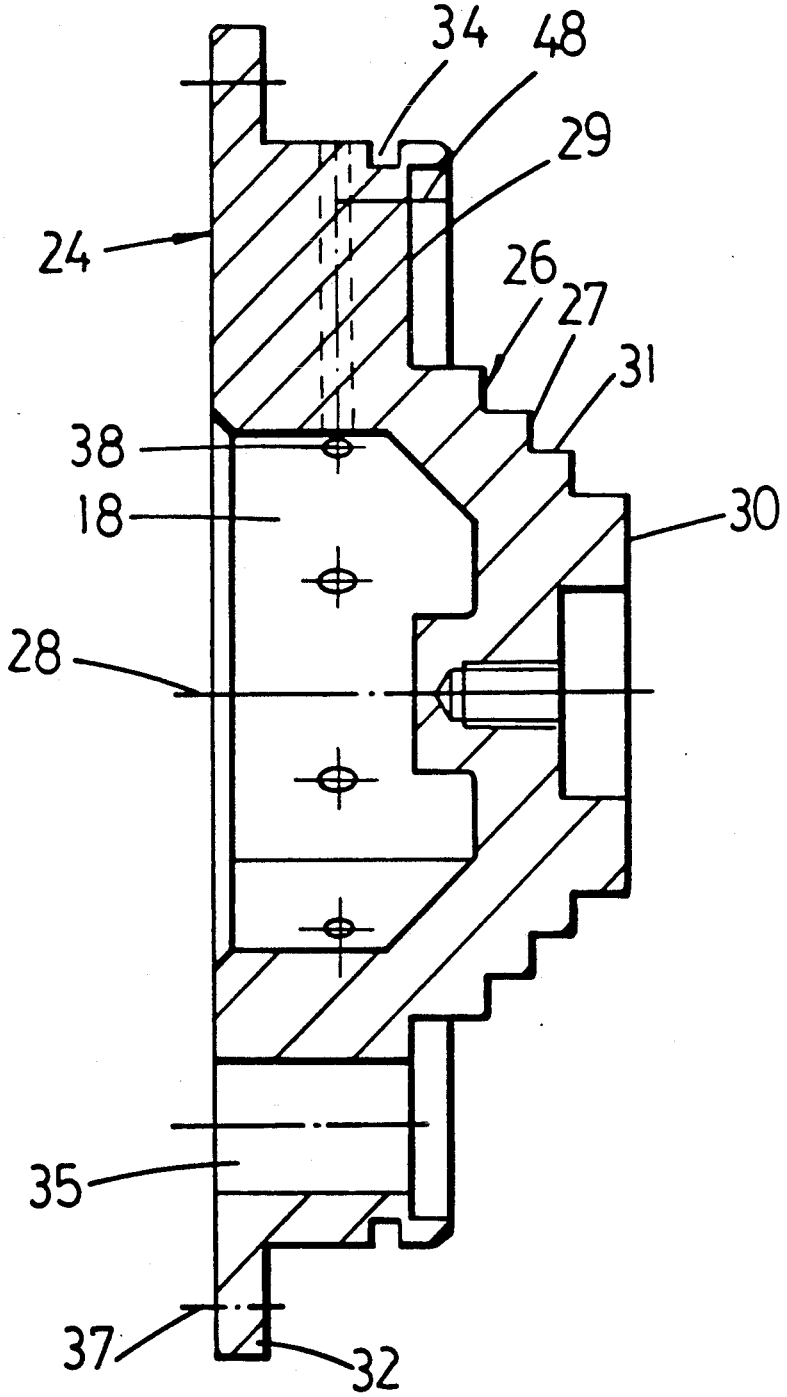
Figure 4:
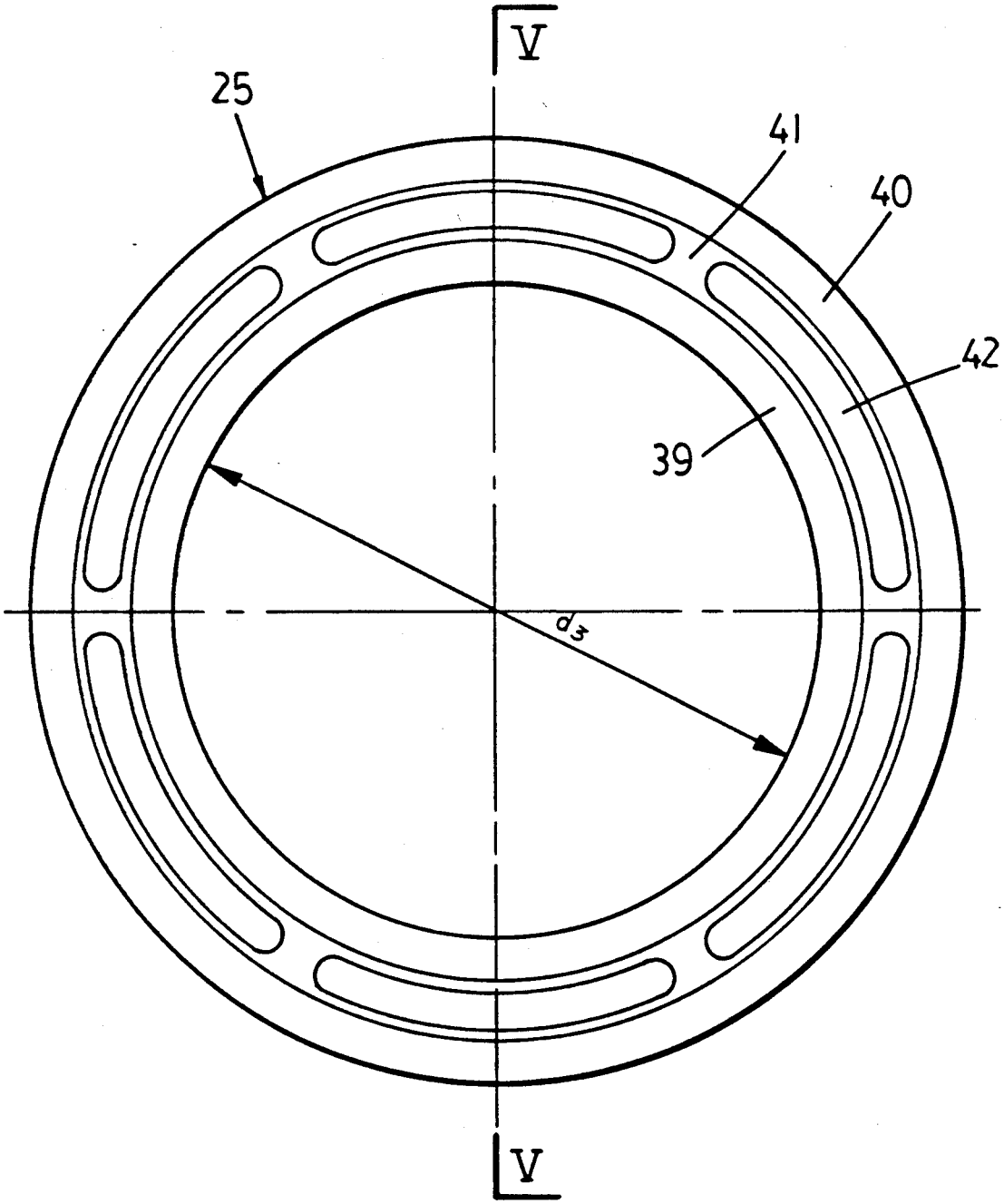
Figure 5:
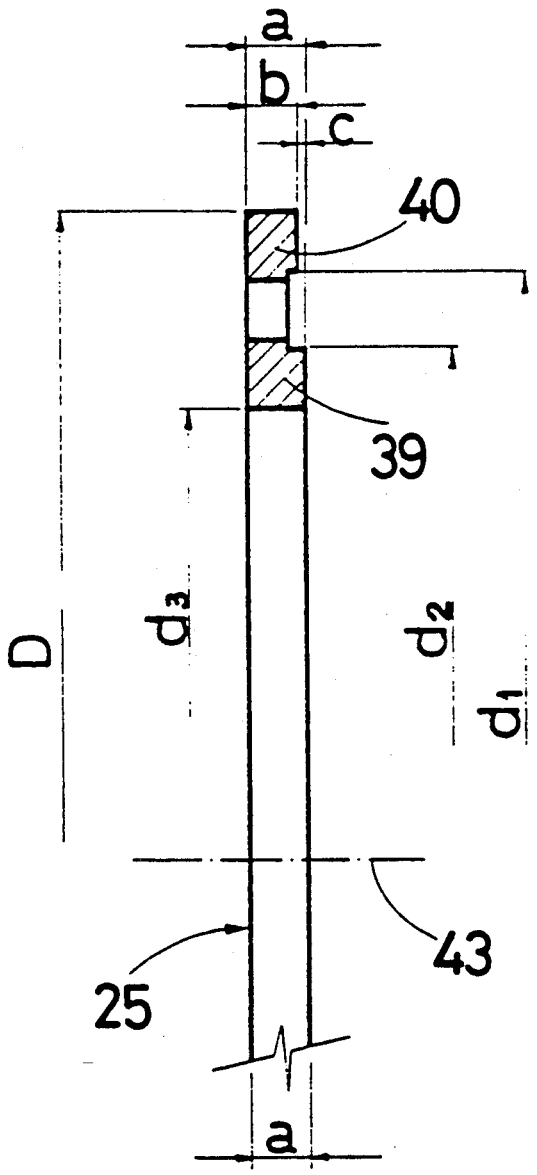

FIG. 3 corresponds to the section III—III of FIG. 2;

FIG. 4 represents one of the rings mounted on the support, in an elevation of its rear part, and FIG. 5 corresponds to the section V—V of FIG. 4.

Figure 1A:
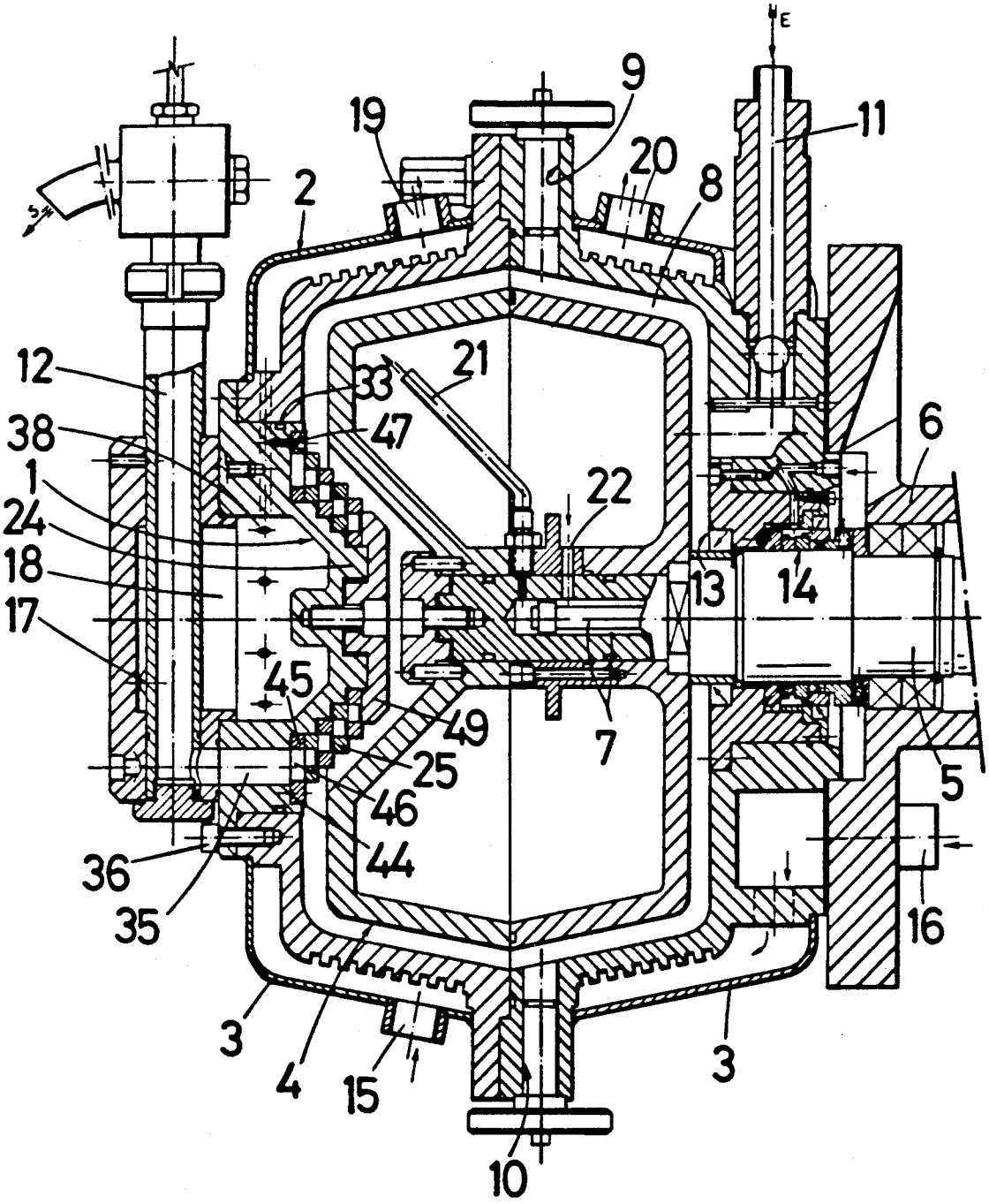
FIGS. 1A and 1B show a view along a longitudinal vertical section of a mill for triturating and breaking up solids predispersed in liquids, which comprises a separator according to the invention.
Figure 1B:
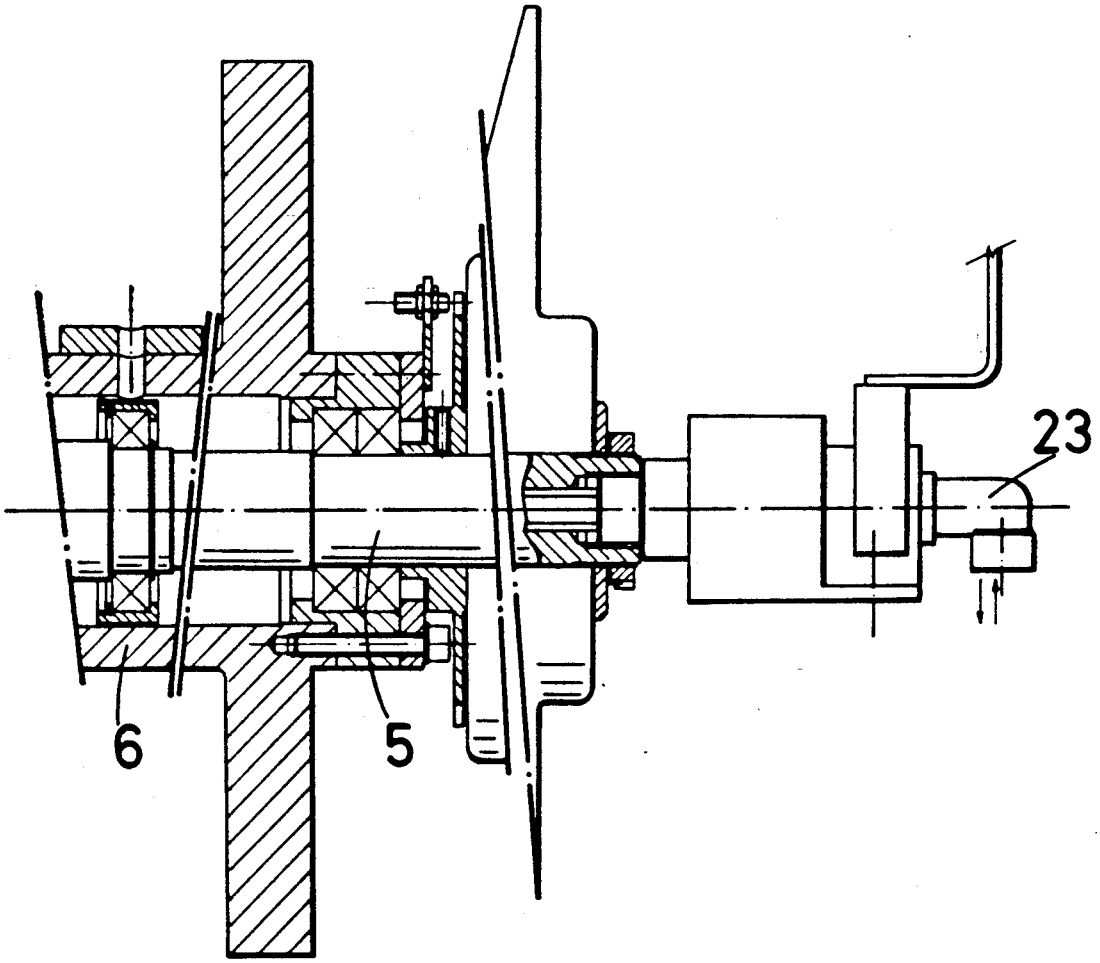

As represented in the drawings and concretely in FIGS. 1A and 1B, the grinding body separator (1) applies to mills for triturating and breaking up solids predispersed in liquids, such as the one represented in said figures, in this example for a mill which is the invention of the same applicant firm as that of the present Patent of Invention and which has been the subject of Spanish Patent Application No. 9002766, although the separator being described in this example could be applied to any other mill of the type which comprises a frame (not shown) on which is mounted a stator (2), with a jacket (3) for cooling and, if and when applicable, for heating the product in treatment, there being provided inside the stator a rotor (4) fastened to a shaft (5) disposed along the longitudinal axis of the mill and mounted overhung on respective supporting and bearing means (6), attached to the frame of the mill and whose shaft has internal lines (7) for rotor cooling and, if and when applicable, heating means. The shaft (5) is rotated by driving means and through respective conventional transmission and speed variation means (not shown), attached to the frame; and between said stator and rotor the grinding chamber (8) is defined, in which are enclosed the grinding bodies initially introduced into said chamber through the inlet (9) of the stator which is closable; in the lower part of the stator is an outlet (10), also closable, for said grinding bodies, and the grinding chamber (8) is traversed by the product in treatment—while the rotor rotates—by conventional means (not shown) impelling said product, which are moved by drive means and through conventional transmission and speed variation means (not shown); the stator (2) having an inlet (11) for the product to be treated, communicating with the exit of the product impulsion means, and an outlet (12) for the ground product, in whose exit zone is arranged the separator (1) which prevents the grinding bodies from coming out but lets the ground product pass; and lastly, between the stator (2) and the shaft (5) seal means are provided, such as the joints (13) and (14), to prevent leakage of the product which circulates continuously and forcedly through the grinding chamber (8).

The jacket (3), which may be made of two parts as in the example illustrated, has inlet lines for cooling and heating (15), (16) and (17)—the latter does not appear in FIG. 1A because of its position, but part of its mouth leading to the cooling chamber of the outlet conduit of the ground product can be seen—and outlet conduits (19) and (20), all of which connect with the respective cooling or heating systems. Likewise, the rotor (4) is cooled by pipes such as pipe (21), which propel the cooling and, if and when applicable, heating liquid into the interior of the rotor, the liquid returning through conduits such as (22); the pipes and conduits are connected to the respective internal lines (7) of shaft (5), which internal lines lead to the outside in the rotating coupling device (23) of shaft (5) connecting with the respective cooling or heating system.

The geometric axis of the type of mill described and illustrated is horizontal but could be vertical.

We shall call front the part of the separator corresponding to the part of the mill situated more toward the exterior thereof with the outlet of the ground product, and rear the opposite part of the mill, that is, the one in contact with the grinding bodies.

The separator (1) is composed of a support (24) (FIGS. 1A, 2 and 3) and a series of rings such as (25) (FIGS. 1A, 4 and 5), which may consist of a variable number of rings, four in the example. The support (24) is stepped and preferably hollow; its ideal geometric envelope is a truncated cone and its steps consist of a series of circular rims (27) superposed along parallel planes, perpendicular to the longitudinal axis (28) of the separator and of decreasing diameter from the major base (29) of the support to its free end or minor base (30). Said series of circular rims alternates with another series of short superposed circular cylinders (31), whose centers are disposed in said longitudinal axis (28) and whose diameters are also decreasing in coordination with the respective diameters of said rims (27).

The major base (29) has a flange (32) and seal means for its installation in the respective mill, such as the joint (33) (FIG. 1A), which is disposed in the circular groove (34) (FIG. 3), said installation being made in the exit zone of the ground product and through the longitudinal passage (35) which opens into the outlet (12) of the ground product. The stepped support (24) is fastened to the front part of the stator (2) by screws (36) which traverse the orifices (37) in the flange (32) of the support, so that said flange is on the outside of the mill while the rest of the support, together with its rings (25), are disposed toward the interior of the grinding chamber (18), as is seen in FIG. 1A. Obviously other joints may, in some cases and must in others, be provided to assure watertightness between the support (24) of the separator (1) and the stator (2), as well as between the passage (35) of the support and the outlet conduit (12) of the ground product, and also in relation to the cooling chamber (18); lastly in this example there are seen orifices such as (38) which connect the chamber (18) and the cooling chamber or chambers defined between the jackets (3) and the body of the stator (2).

The mounting of the described separator facilitates its disassembly without having to disassemble, in turn, the stator or the front part thereof.

The separator is completed with a series of circular rings (25) of decreasing ddiameters from the major base (29) of the support (24) to the free end or minor base (30) of the latter, each of said rings being made up of an inner collar (39) and an outer collar (40) (FIGS. 4 and 5), both of square cross section and interconnected by bridges such as (41), the latter defining, together with said two collars, respective transverse orifices or passages such as (42). Each ring, in this case four as shown in FIGS. 4 and 5, fits on a respective step (26), for which the inside diameter (d3 of its inner collar (30) matches, with the necessary fit, the outside diameter of the circular cylinder (31) of the step on which it is mounted.

The outside diameter (D) of the outer collar (40) of each of the rings that follow the largest of them coincides with the inside diameter (d1) of the outer collar (40) of the ring on which it is juxtaposed, with the thickness (a)—measured in the direction of the longitudinal axis (28) of the support of the separator—of the inner collar (39) of a ring being somewhat greater than the thickness (b) of its outer collar (40), thus causing a separation (c) between each pair of juxtaposed rings—in the direction of the coincident transverse axis of the rings (43), which coincides with the axis (28) of the support (24)—which is smaller than the smallest of the thicknesses or diameters of the grinding bodies to be retained in the grinding chamber (8). It should be pointed out that the separation (c) between each pair of rings juxtaposed in the manner described coincides exactly with the difference between the thicknesses (a) and (b) of a same ring (FIG. 5), that is to say, $c=a-b$, the juxtaposed mounting of the rings being seen in FIG. 1A.

The outer collar (40) of each of the rings that follow the largest of them defines a space, relative to the inner collar (39) of the ring (of greatest diameter D) on which it is juxtaposed, which is greater than said separation (c) between each pair of rings, that is to say, the inside diameter (d1) of the outer collar (40) of the ring of smaller diameter, which is juxtaposed to the following ring of greater diameter (see FIG. 1A) is greater than the outside diameter (d2) of the inner collar of said ring of greater diameter, establishing or defining between both rings and in this part thereof a circular separation which is greater than said also circular separation (c).

Preferably but not necessarily, there is removably fastened on the major base (29) of the stepped support (24) a first circular collar (44) (FIG. 1A) of square cross section and of greater outside diameter than the diameter (D) of the largest ring (25) of the series of rings, the inside diameter of said first collar coinciding with the outside diameter (D) of the outer collar (40) of said largest ring. Again preferably but not necessarily, there is provided in coplanar and coaxial arrangement a second collar (45) similar to the first but of smaller diameter, which is practically equal to the inner collar (39) of the larger ring to which it is juxtaposed, the thickness of said second collar—in axial direction—being somewhat greater than the thickness of the outer collar (40) of said largest ring, thus forming between them a separation—in axial direction—which is smaller than the smallest thickness or diameter of the grinding bodies. Between the first and second circular collars a kind of circular channel (46) is defined for the passage of the ground product toward the exit of the mill, which channel communicates with the longitudinal orifice or passage (35) that traverses the flange (32) of the support (24); and it should be pointed out that there may be more than one such longitudinal orifices (35), as needed in the operation of the mill.

The first collar (44) is removably fastened to the support (24) by screws (47) which are screwed into threaded holes (48) (FIGS. 2 and 3) of the support; and the assembly composed of the series of rings (25) and the second collar (45) is retained and immobilized by a disk (49) which is applied against the smallest ring and is removably fastened, (for example by a central screw), on the minor base (30) of the stepped support (24) of the separator (1), the outside diameter of said disk being equal to the inside diameter (d1) of the outer collar (40) of said smallest ring, while between the peripheral edge of this disk (49) and the opposite edge of said outer collar of the smallest ring a separation is defined equal to the separation (c) between each pair of juxtaposed rings.

The section of the passages for retention of the grinding bodies, defined by the separations between the juxtaposed rings and as described before, is smaller than the section of the rest of the internal passages, thereby reducing the probability of any clogging or stopping up of the ground product occurring in this part of the separator.

It should be noted that, in the realization of the grinding body separator in mills for triturating and breaking up solids predispersed in liquids which is the subject of the present Patent of Invention, all variants of detail may be applied which experience and practice may suggest as to forms and dimensions, both absolute and relative, number of component parts, materials employed in them and other circumstances of an accessory nature, and also there may be introduced whatever modifications of structural detail are compatible with the essence of what is claimed, as all of it is included in the spirit of the following claims.

I claim:

1. Grinding body separator in mills for triturating and breaking up solids predispersed in liquids, of the type which comprises a frame on which is mounted a fixed element or stator, with a jacket for the cooling or, for the heating of the product in treatment, in the interior of which a rotating element or rotor is disposed fastened to a shaft disposed along the longitudinal axis of the mill and mounted overhung on respective supporting and bearing means attached to the frame of the mill, which shaft has internal lines for rotor cooling or, heating media and is made to rotate by drive means through respective transmission and speed variation means attached to the frame, there being defined between said stator and rotor the grinding chamber, in which grinding bodies are enclosed which are initially introduced into said chamber through a closable entrance of the stator, in whose lower part is located a likewise closable outlet for their evacuation, the grinding chamber being traversed by the product in treatment while the rotor rotates —owing to means of impulsion of said product, which are moved by drive means and through transmission and speed variation means, the stator having an entrance of the product to be treated, communicating with the exit of the impulsion means and an exit of the ground product, in the exit zone of which are disposed separator means which prevent the grinding bodies from coming out but let the ground product pass, seal means being disposed between the stator and the shaft to prevent leakage of the product which circulates continuously and forcedly through the grinding chamber; characterized in that the separator presents a hollow stepped support whose ideal geometric envelope is a truncated cone, whose steps are formed by a series of circular rims superposed along parallel planes, perpendicular to the longitudinal axis of the separator and of decreasing diameter from the major base of the support to its free end, which series alternates with another series of short circular superposed cylinders, whose centers are disposed in said longitudinal axis of the separator and whose diameters are also decreasing in coordination with the respective diameters of said rims, the major base of the support comprising a flange and seal means for its installation in the respective mill, in the exit zone of the ground product; in that it presents a series of circular rings of decreasing diameters from the major base of the support to its free end, each of them made up of an inner collar and an outer collar, both of square cross section and interconnected by bridges which define respective transverse orifices or passages, each ring fitting on a respective step, for which purpose the inside diameter of its inner collar matches the outside diameter of the circular cylinder of the step on which it is mounted; in that the outside diameter of the outer collar of each of the rings that follow the largest of them coincides with the inside diameter of the outer collar of the ring on which it is juxtaposed, and the thickness—measured in the direction of the longitudinal axis of the separator—of the inner collar of a ring is somewhat larger than that of its outer collar, causing a separation between each pair of juxtaposed rings, in axial direction, which is smaller than the smallest thickness or diameter of the grinding bodies to be retained in the grinding chamber; in that the outer collar of each of the rings which follow the largest of them delimits a space, relative to the inner collar of the ring on which it is juxtaposed, which is greater than said separation between each pair of rings; in that, there is removably fastened on the major base of the support a first circular collar of square cross section and of an outside diameter greater than that of the largest of the series of rings, whose inside diameter coincides with the outside diameter of the outer collar of the largest ring, and also there is provided, in coplanar and coaxial arrangement, a second circular collar similar to the first but smaller and practically equal to the inner collar of the largest ring to which it is juxtaposed, the thickness of said second collar, in axial direction, being somewhat greater than that of the outer collar of said largest ring, causing a separation, in axial direction, between the two smaller than the smallest thickness or diameter of the grinding bodies, defining between said first and second circular collars a kind of channel for the passage of the ground product toward the exit of the mill, through at least one longitudinal orifice in the flange of the support; and in that the assembly composed of the series of rings and the second collar is retained and immobilized by means of a disk applied against the smallest ring and removably fastened on the minor base of the stepped support of the separator, the outside diameter of said disk being equal to the inside diameter of the outer collar of the smallest ring, and between the peripheral edge of this disk and the opposite edge of said outer collar of the smallest ring a separation is defined equal to that between each pair of juxtaposed rings.

* * * * *

UNITED STATES PATENT AND TRADEMARK OFFICE

CERTIFICATE OF CORRECTION

PATENT NO. : 5,114,080

DATED : May 19, 1992

INVENTOR(S) : Carlos Oliver Pujol

It is certified that error appears in the above—identified patent and that said Letters Patent is hereby corrected as shown below:

On the title page:

Add the following missing priority data:

(30) Foreign Application Priority Data

Oct. 31, 1990 (SP) Spain.....9002767

Signed and Sealed this

Fifteenth Day of March, 1994

Attest:

Bruce Lehman

BRUCE LEHMAN

Attesting Officer

Commissioner of Patents and Trademarks